US006357139B1

(12) United States Patent
Sassi

(10) Patent No.: US 6,357,139 B1
(45) Date of Patent: Mar. 19, 2002

(54) WASHING DEVICE FOR CLEANING MACHINES INCORPORATING AT LEAST ONE OF SAID WASHING DEVICE

(75) Inventor: Stefano Sassi, Moncalieri (IT)

(73) Assignee: R.E.A.S.N.C. Di Sassi E. Baudin & C. (IT)

( * ) Notice: Subject to any disclaimer, the term of this patent is extended or adjusted under 35 U.S.C. 154(b) by 0 days.

(21) Appl. No.: 09/542,030

(22) Filed: Apr. 3, 2000

(51) Int. Cl.[7] ..... F26B 19/00

(52) U.S. Cl. ..... 34/210; 134/186; 134/199; 15/310

(58) Field of Search ..... 34/202, 210, 68, 34/85; 15/310; 134/199, 186, 200

(56) References Cited

U.S. PATENT DOCUMENTS 5,640,734 A * 6/1997 Kuwashima ..... 15/3.5

FOREIGN PATENT DOCUMENTS

IT 01267168 11/1994

* cited by examiner

*Primary Examiner*—Jiping Lu
(74) *Attorney, Agent, or Firm*—Paul&Paul

(57) ABSTRACT

A steam washing device comprising a metal body having a recess housing the part to be washed, the recess being provided with ducts for introducing the steam into the recess and discharging it from the recess; there being provided three ducts for introducing the steam and one for discharging the steam; the recess being defined by a wall of a sleeve provided with through holes communicating the recess with a steam expansion chamber; one of the ducts being adapted to introduce the steam into the expansion chamber, whereas the remaining two ducts are adapted to introduce the steam into the recess; a slit opening in the chamber forming a steam sucking duct that in turn is connected with the system exhaust duct.

6 Claims, 4 Drawing Sheets

WASHING DEVICE FOR CLEANING MACHINES INCORPORATING AT LEAST ONE OF SAID WASHING DEVICE

TECHNICAL FIELD

The present invention relates to an improved washing device or washer, adapted for assembling cleaning machines incorporating at least one of said washing devices.

BACKGROUND ART

Italian patent No. 01267168 filed on Nov. 25, 1994 in the name of the present applicant discloses and claims a steam washing device for cleaning parts or pieces of any shape obtained from machining, as well as a washing machine equipped with some of said washing devices. Such washing device employs a pressurised flow of saturated steam as a cleaning fluid.

In the device of the above patent, the steam acts as a cleaning fluid which is exhausted together with the dirt at the end of the washing, by conveying it outside the machine through a drain duct.

SUMMARY OF THE INVENTION

The object of the present invention is to improve the performance of the above illustrated steam washing device to make it adapted to completely wash pieces of metal smallware contained therein while solving the problem of discharging outside the steam and the dirt.

Another object of the present invention is to allow the introduction—if required—of a liquid cleaning material together with the steam, in order to improve the cleaning and/or the degreasing of such pieces of metal smallware.

The novel features of the washing device of the invention are set forth in the attached claims.

BRIEF DESCRIPTION OF THE DRAWINGS

The invention will now be disclosed in details with particular reference to the attached drawings illustrating only exemplary and non-limiting embodiments thereof, in which.

DETAILED DESCRIPTION OF THE INVENTION

Figure 1:
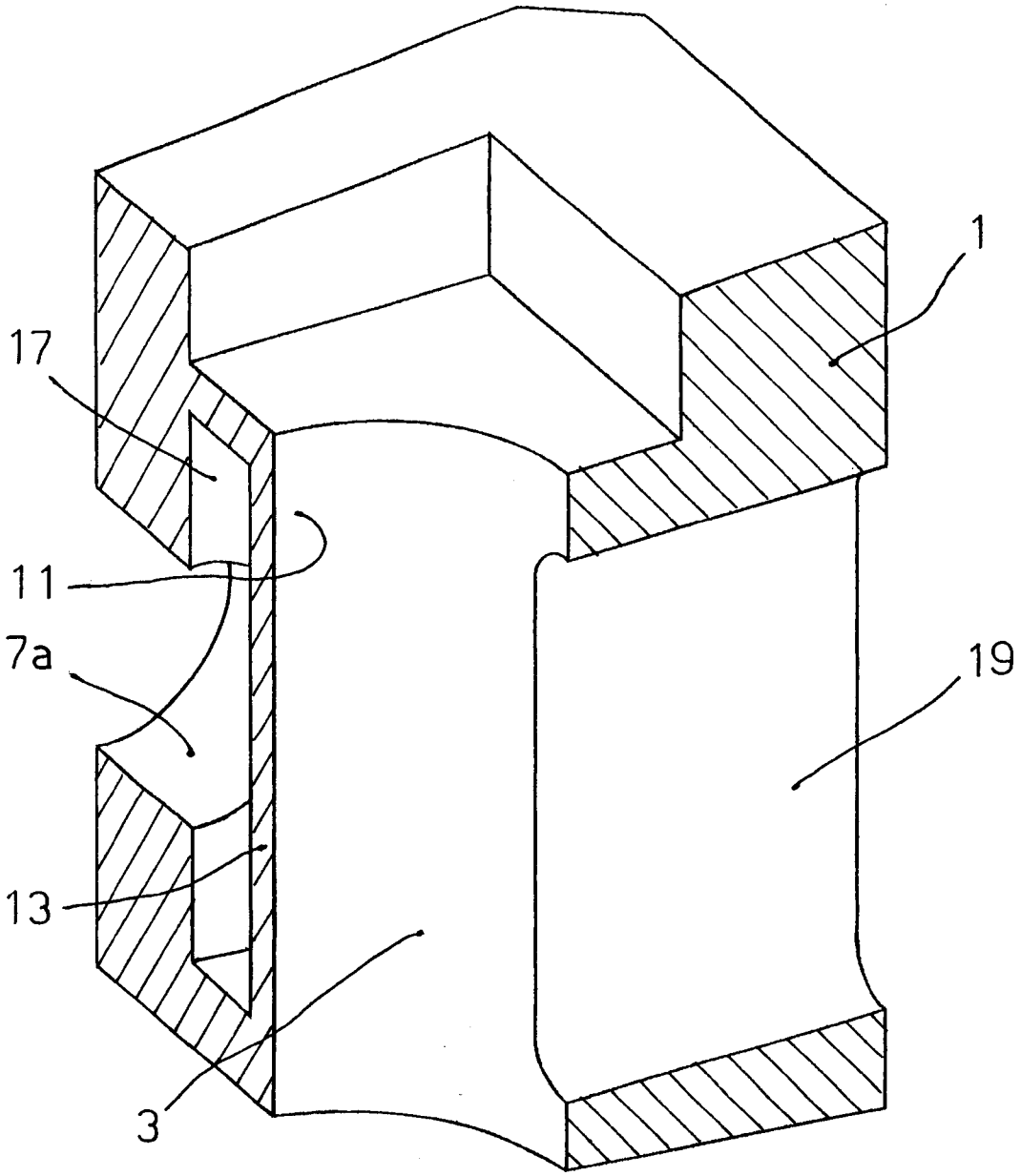
FIG. 1 is a perspective scrap view with portions removed illustrating a washing device according to the invention.
Figure 2:
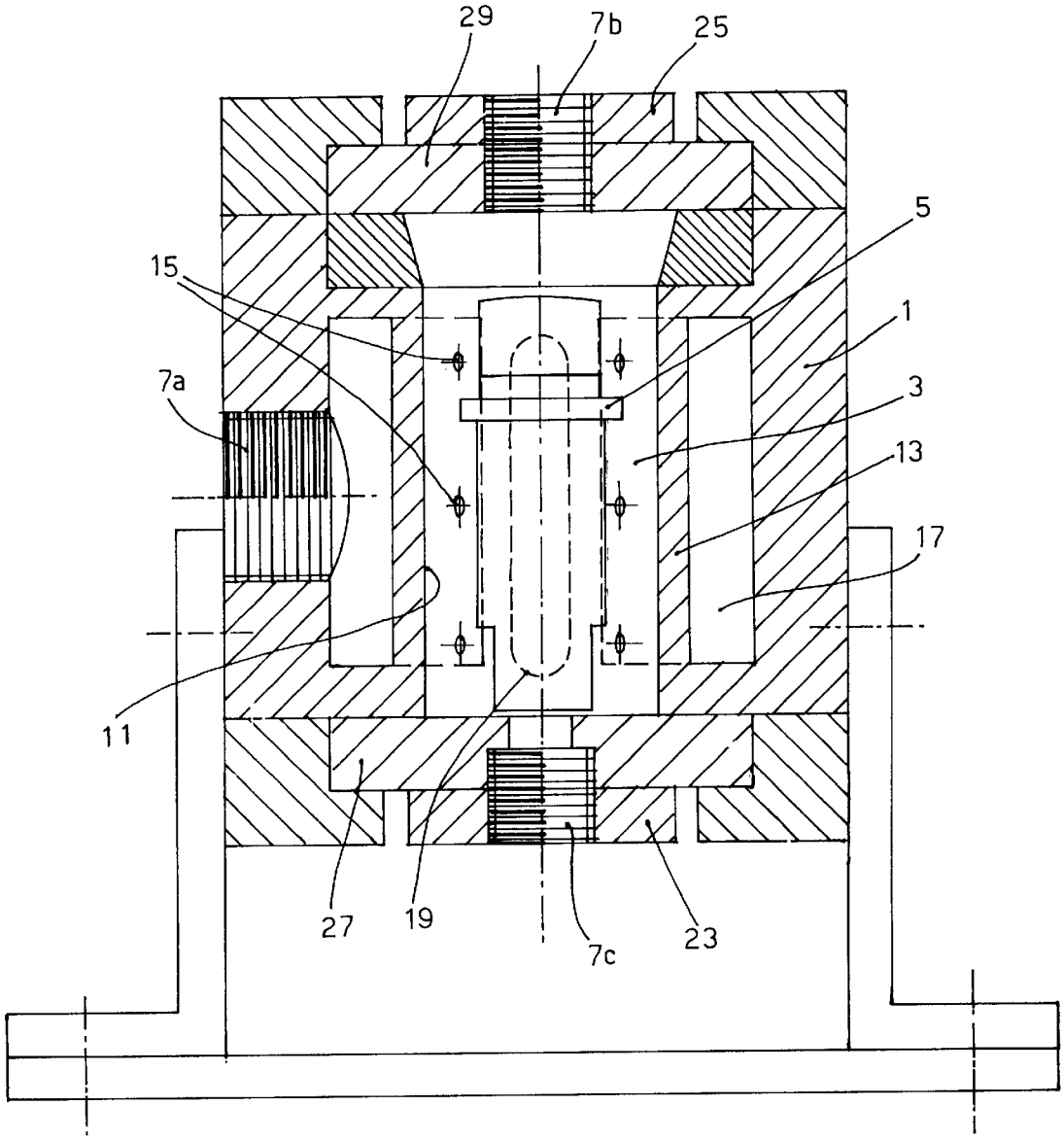
FIG. 2 is a cross section view (in a vertical plane) of a device according to the invention.
Figure 3:
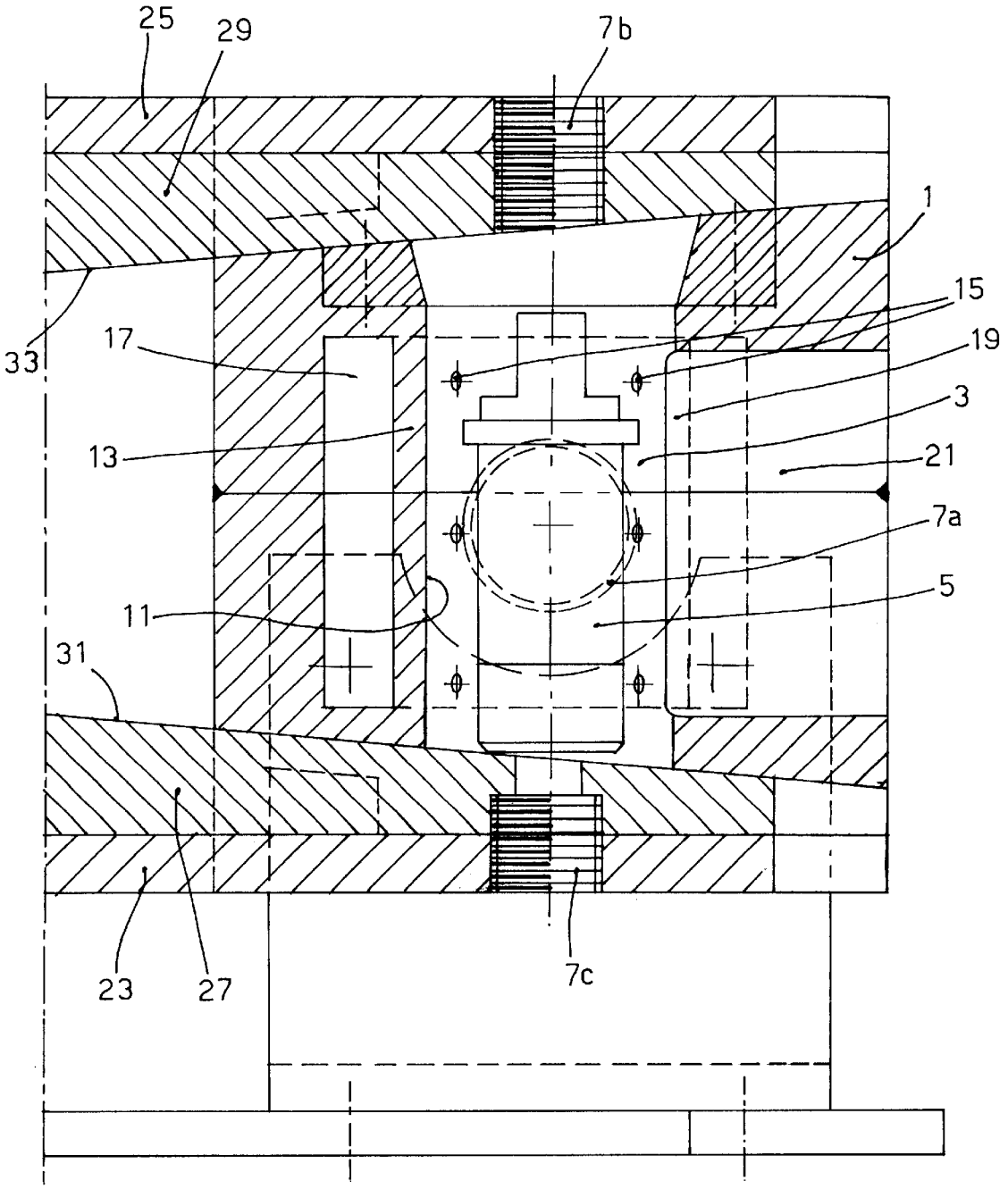
FIG. 3 shows a cross section view of a device according to the invention, in a vertical plane rotated by 90° with respect to the section plane of FIG. 2.
Figure 4:
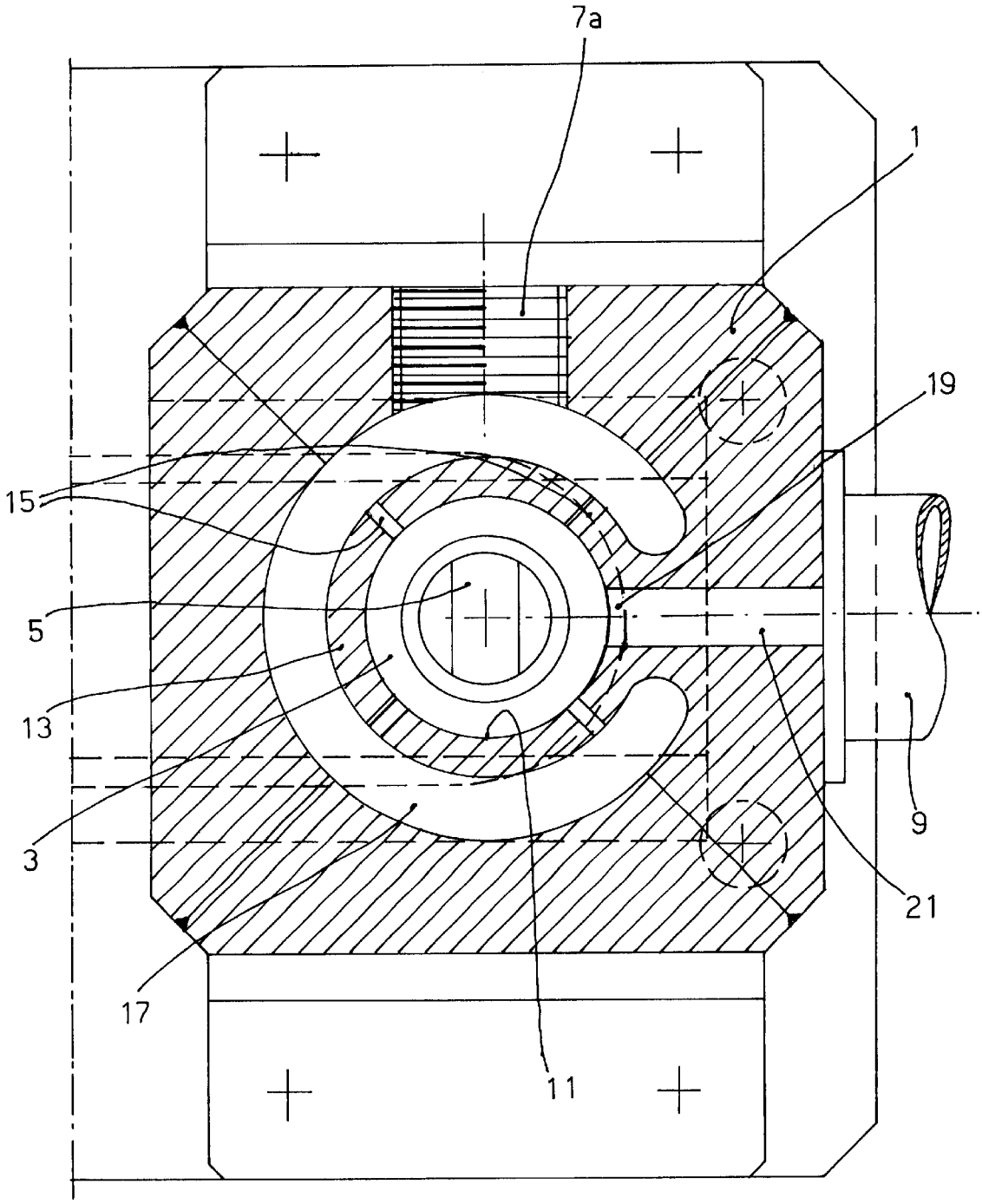
FIG. 4 is a cross section view of a device according to the invention in a horizontal plane above the expansion chamber.

As shown in the Figures, the washing device according to the invention substantially comprises a metal body 1 provided with an inner hollow or recess 3 for temporarily housing the part 5 to be washed and connected to the ousted by three ducts 7*a*, 7*b*, 7*c* for introducing the steam into the recess, and by a duct 9 for the outlet of said steam.

The recess 3 containing the part 5 to be washed is externally defined by the inner wall 11 of a cylindrical sleeve member 13, which wall is provided with a plurality of through holes 15 communicating said recess 3 with a C-shaped annular recess 17 concentric to the sleeve 13 and forming an expansion chamber for the steam.

The through holes 15 in the inner wall 11 of said sleeve 13 communicate with the annular recess 17 and are arranged in two vertical equally spaced rows, each row comprising a plurality a plurality of through holes 15. Optimally, there are twelve through holes 15, arranged in four rows, each comprising three through holes 15.

One of the three ducts for introducing the steam, and more precisely the lateral duct 7*a*, communicates with the expansion chamber 17, whereas the remaining two ducts 7*b* and 7*c* are formed at the top and the bottom of the metal body 1, respectively, and serve for injecting the steam, respectively from above and below, into the recess or washing chamber 3 containing the part 5 to be washed.

The washing chamber 3 comprises a slit opening 19 forming a duct 21 for sucking the steam, connected with the system exhaust duct 9 which in the illustrated embodiment is horizontal at about 90° to the steam introduction duct 7.

The body 1 is retained between two support members, a lower support member 23 and an upper support member 25, on which support members respective slideways or guides 27 and 29 are located. Each of such guides comprises a tilted surface or side (at 31 and 33, respectively). At an advanced position, such guides can block both the part 5 retained by the lower guide 23 and the metal body 1, while at a retracted position they unlock both the part 5 to be washed and the metal body 1 in order to remove such (washed) part 5 and position another part inside the device.

I claim:

1. A washing device for building a cleaning machine incorporating at least one of said washing devices, said device comprising a metal body having an inner recess adapted to house the part to be washed and provided with ducts for introducing the steam into said recess and discharging it therefrom, wherein are provided three of such ducts for introducing the steam, and one duct for discharging the steam;

wherein said recess housing the part to be washed is externally defined by the inner wall of a cylindrical sleeve, said wall being provided with a plurality of through holes communicating said recess with a C-shaped annular recess concentric to said sleeve and forming an expansion chamber for the steam;

wherein one of said three ducts for introducing the steam, and more precisely the lateral duct, communicates with said expansion chamber, whereas the remaining two ducts are formed at the top and the bottom of the metal body respectively, for introducing the steam into the recess or washing chamber housing the part to be washed from above and below; and wherein said washing chamber comprises a slit opening forming a duct for sucking the steam, communicating with said system exhaust duct.

2. A steam washing device as claimed in claim 1, wherein said through holes in the inner wall of said sleeve and communicating with the annular recess or expansion chamber are arranged in two vertical equally spaced rows, each row comprising a plurality of said holes.

3. A steam washing device as claimed in claim 2, comprising twelve through holes, arranged in four rows, each comprising three holes.

4. A steam washing device as claimed in claim 1, wherein the duct for introducing the steam into the expansion chamber is horizontally arranged, and the suction duct connected to the steam exhaust duct is horizontally arranged too and substantially orthogonal to said duct.

5. A steam washing device as claimed in claim 1, wherein said metal body is retained between two support members, a lower support member and an upper support member, on which support members respective guides are located, each of such guides comprising a tilted surface, at an advanced position, said guides blocking both the part retained by the lower guide and the metal body, while at a retracted position they unlock both the part to be washed and the metal body in order to remove a washed part and position another part inside the device.

6. A steam washing machine for metal parts such as small machined parts, comprising at least one washing device as claimed in any of the preceding claims.

* * * * *